US011164505B2

(12) United States Patent
Tsuchi et al.

(10) Patent No.: US 11,164,505 B2
(45) Date of Patent: Nov. 2, 2021

(54) DISPLAY APPARATUS INCLUDING DISPLAY CONTROLLER WITH LUMINANCE CONTROL

(71) Applicant: LAPIS Semiconductor Co., Ltd., Yokohama (JP)

(72) Inventors: Hiroshi Tsuchi, Yokohama (JP); Katsunori Ito, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 16/738,726

(22) Filed: Jan. 9, 2020

(65) Prior Publication Data

US 2020/0152112 A1 May 14, 2020

Related U.S. Application Data

(63) Continuation of application No. 15/914,118, filed on Mar. 7, 2018, now Pat. No. 10,559,248.

(30) Foreign Application Priority Data

May 9, 2017 (JP) ..... 2017-93045
Jan. 30, 2018 (JP) ..... 2018-13314

(51) Int. Cl.
*G09G 3/36* (2006.01)
*G09G 3/20* (2006.01)
(Continued)

(52) U.S. Cl.
CPC ..... *G09G 3/2022* (2013.01); *G09G 3/3225* (2013.01); *G09G 3/3266* (2013.01);
(Continued)

(58) Field of Classification Search
CPC ..... G09G 3/3611; G09G 2320/0233
See application file for complete search history.

(56) References Cited

U.S. PATENT DOCUMENTS

2003/0214494 A1* 11/2003 Morishita ..... G09G 3/20 345/204
2005/0231453 A1 10/2005 Park et al.
(Continued)

FOREIGN PATENT DOCUMENTS

JP H07-56143 A 3/1995
JP H07-318898 A 12/1995
(Continued)

*Primary Examiner* — Roy P Rabindranath
(74) *Attorney, Agent, or Firm* — Rabin & Berdo, P.C.

(57) ABSTRACT

A display apparatus includes: a display panel; a gate driver that provides, to a plurality of scanning lines, scanning pulse signals for controlling pixel switches to be ON in a selection period corresponding to a pulse width thereof; a data driver that provides gradation voltage signals to a plurality of data lines; and a display controller that provides a modulated clock signal having a frequency that changes at a predetermined rate in one frame period. The gate driver sequentially provides the scanning pulse signals each having a pulse width reflecting to a clock cycle of the modulated clock signal in a predetermined order corresponding to distances from the data driver to the plurality of scanning lines. The data driver provides the gradation voltage signals in the order of providing the scanning pulse signals for every data period corresponding to the clock cycle of the modulated clock signal.

5 Claims, 15 Drawing Sheets

(51) Int. Cl.
*G09G 3/3266* (2016.01)
*G09G 3/3225* (2016.01)
*G09G 3/3275* (2016.01)

(52) U.S. Cl.
CPC ..... *G09G 3/3275* (2013.01); *G09G 3/3677* (2013.01); *G09G 3/3688* (2013.01); *G09G 2310/0213* (2013.01); *G09G 2310/08* (2013.01); *G09G 2320/0223* (2013.01); *G09G 2320/0233* (2013.01)

(56) References Cited

U.S. PATENT DOCUMENTS

2008/0074378 A1* 3/2008 Chuang ..... G09G 3/3611 345/98
2010/0180228 A1* 7/2010 Ben-Harrush ..... G06F 3/0482 715/803
2018/0182355 A1* 6/2018 Kobayashi ..... G09G 5/10

FOREIGN PATENT DOCUMENTS

JP H08-95000 A 4/1996
JP 2009-175303 A 8/2009

* cited by examiner

DISPLAY APPARATUS INCLUDING DISPLAY CONTROLLER WITH LUMINANCE CONTROL

CROSS-REFERENCE TO RELATED APPLICATIONS

This is a continuation of U.S. application Ser. No. 15/914,118, filed on Mar. 7, 2018, which is based upon and claims the benefit of priority from Japanese Patent Applications No. 2017-93045, filed on May 9, 2017 and No. 2018-13314, filed on Jan. 30, 2018. The entire disclosures of these prior U.S. and foreign applications are incorporated herein by reference.

BACKGROUND OF THE INVENTION

1. Field of the Invention

The present invention relates to a display apparatus and a display controller.

2. Description of the Related Art

An active matrix driving scheme has been employed as a driving scheme for display devices such as liquid crystal display apparatuses or organic electroluminescence (EL) display apparatuses. In a display apparatus employing the active matrix driving scheme, a display panel includes a semiconductor substrate on which pixel units and pixel switches are arranged in a matrix shape. ON and OFF of the pixel switches are controlled by scanning pulse signals. When the pixel switches are ON, gradation voltage signals corresponding to a video data signal are provided to the pixel units to control the luminance of each of the pixel units. In this manner, display is performed. The scanning pulse signals are provided to scanning lines by a gate driver. The gradation voltage signals are provided by a data driver via data lines.

In order to eliminate disturbance in display images, which is generated according to errors in various characteristics such as scanning line capacitance or liquid crystal capacitance due to production variations, in a liquid crystal display apparatus employing the active matrix driving scheme, it has been proposed a liquid crystal display apparatus including storage means that stores information indicating timing for turning pixel switches ON and OFF and capable of specifying timing after the production of the apparatus (for example, Japanese Patent Application Laid-Open No. Hei. 8-095000).

SUMMARY OF THE INVENTION

As a display apparatus used for a television or a monitor, demand for a high-resolution display apparatus having a large screen, such as a 4K panel or an 8K panel, has been increasing. As a display panel is made to have a larger screen and a higher resolution, a selection period of a scanning pulse signal (pulse width of the scanning pulse signal) outputted from a gate driver becomes shorter. Load capacitance of a data line of the display panel to be driven by a data driver, on the other hand, becomes larger, and a driving period per one pixel driven by the data driver (data period during which a gradation voltage signal is provided to the data line) also becomes shorter corresponding to the selection period of the scanning pulse signal.

When the load capacitance of the data line increases and the driving period shortens, an output signal from an output circuit of the data driver has a signal waveform having nearly no rounded rising edge at a position close to the output circuit on the data line (hereinafter, referred to as a data line near end). The output signal, however, has a signal waveform having a more rounded rising edge toward a position farther away from the output circuit on the data line (hereinafter, referred to as a data line far end). Consequently, a rate of writing to a pixel electrode (a rate at which the pixel electrode reaches a target voltage by charging or discharging operation) decreases.

Specifically, for example of charging operation, the influence of the impedance of the data line is small in the data line near end, and thus the rising edge of the signal waveform of the gradation voltage signal has a less rounded edge. Consequently, the voltage level of the provided gradation voltage signal can be written into the pixel electrode as it is. In the data line far end, on the other hand, the rising edge of the signal waveform has a significantly rounded edge due to the large influence of the impedance of the data line. Consequently, the provided gradation voltage level cannot be reached within one data period, and thus a voltage level below the voltage level of the provided gradation voltage signal is written into the pixel electrode. Consequently, luminance varies for the same gradation level on the display panel, resulting in deteriorated image quality such as luminance unevenness.

The present invention has been made in view of the aforementioned problem, and it is an object of the present invention to provide a display apparatus that enables display while suppressing luminance unevenness.

An aspect of the present invention is a display apparatus including: a display panel including a plurality of data lines and a plurality of scanning lines intersecting each other, and pixel switches and pixel units arranged in a matrix shape, each of the pixel switches and the pixel units being provided at each of intersections of the plurality of data lines and the plurality of scanning lines; a gate driver configured to periodically provides scanning pulse signals to the respective scanning lines for controlling the pixel switches to be ON in a selection period corresponding to a pulse width; a data driver configured to provide gradation voltage signals corresponding to video data signals to the plurality of data lines; and a display controller configured to provide the video data signals to the data driver and provide, to the gate driver and the data driver, a modulated clock signal having a frequency that changes at a predetermined rate in one frame period during which the video data signals for one screen are provided. The gate driver sequentially provides the scanning pulse signals each having a pulse width corresponding to a clock cycle of the modulated clock signal to the plurality of scanning lines in a predetermined order corresponding to distances from the data driver to the plurality of respective scanning lines. The data driver provides the gradation voltage signals to the plurality of data lines in the order of providing the scanning pulse signals for every data period corresponding to the clock cycle of the modulated clock signal.

Another aspect of the present invention is a display controller, connected to a display apparatus including a gate driver and a data driver, for controlling the gate driver and the data driver. The display controller is configured to provide, to the gate driver and the data driver, a modulated clock signal having a frequency that changes at a predetermined rate in one frame period during which video data signals for one screen are provided.

Another aspect of the present invention is a data driver connected to a display panel comprising a plurality of data lines and a plurality of scanning lines intersecting each other, and pixel switches and pixel units arranged in a matrix shape, each of the pixel switches and the pixel units being provided at each of intersections of the plurality of data lines and the plurality of scanning lines, the data driver being configured to provide gradation voltage signals corresponding to video data signals to the plurality of data lines. The data driver receives a modulated clock signal having a frequency that changes at a predetermined rate in one frame period during which the video data signals for one screen are provided, and the data driver provides the gradation voltage signals to the plurality of data lines for every data period corresponding to a clock cycle of the modulated clock signal.

The display apparatus according to the present invention enables display while suppressing luminance unevenness on a display panel plane.

BRIEF DESCRIPTION OF THE DRAWINGS

Features of the present invention will be described in the following description with reference to the accompanying drawings, wherein.

DETAILED DESCRIPTION OF THE INVENTION

Figure 1:
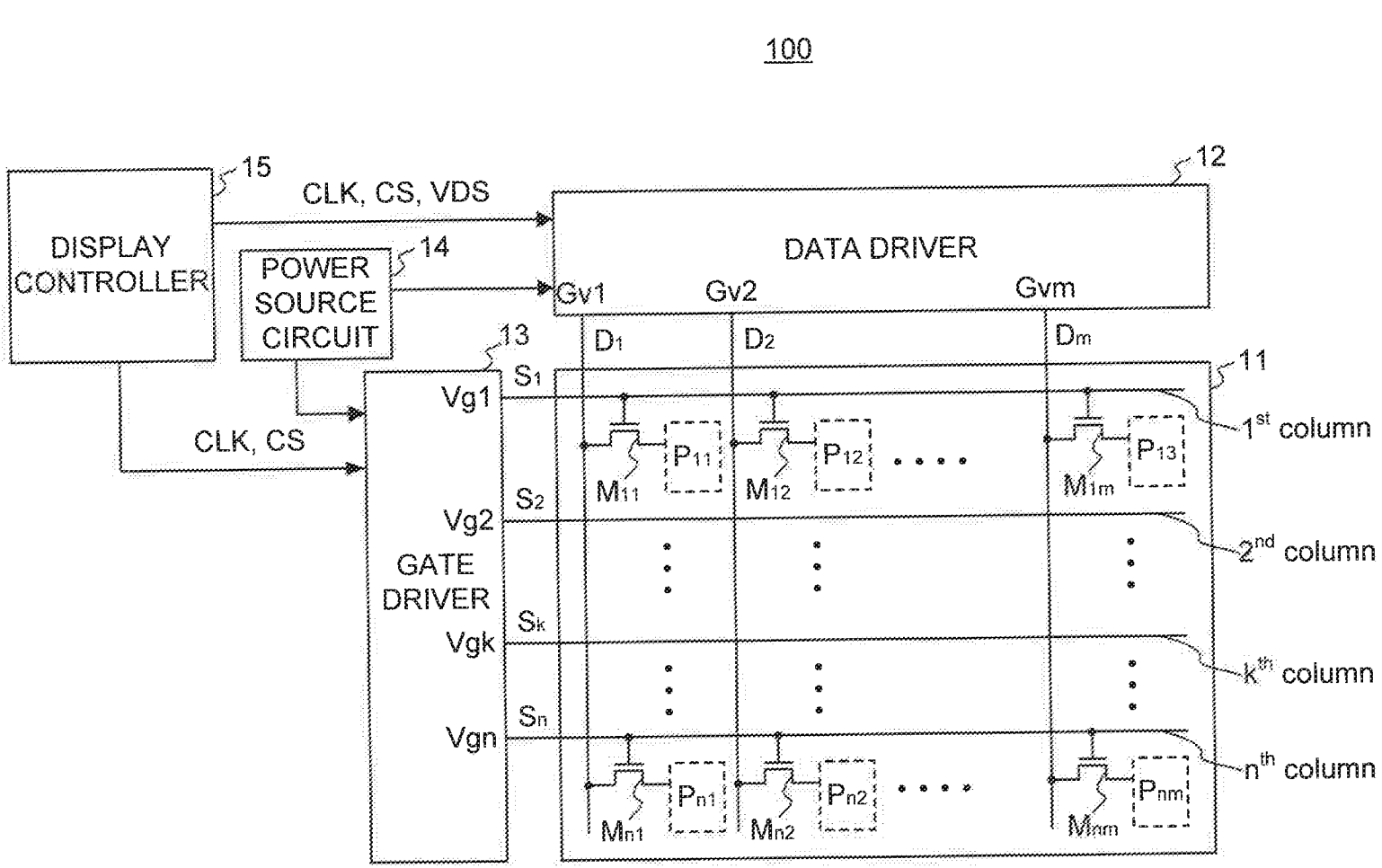
FIG. 1 is a block diagram illustrating a configuration of a display apparatus according to a first embodiment of the present invention.

Embodiments of the present invention will now be described below with reference to the drawings. In the description of the following embodiments and the accompanying drawings, substantially the same or equivalent elements will be denoted by the same reference numerals.

First Embodiment

FIG. 1 is a block diagram illustrating a configuration of a display apparatus 100 according to the present embodiment. An example of the display apparatus 100 is a liquid crystal display apparatus employing an active matrix driving scheme. The display apparatus 100 includes a display panel 11, a data driver 12, a gate driver 13, a power source circuit 14, and a display controller 15.

The display panel 11 includes a semiconductor substrate on which a plurality of pixel units $P_{11}$ to $P_{nm}$ and a plurality of pixel switches $M_{11}$ to $M_{nm}$ (n, m: a natural number larger than or equal to two) are arranged in a matrix shape. The display panel 11 includes n scanning lines $S_1$ to $S_n$ and m data lines $D_1$ to $D_m$ disposed so as to intersect with the scanning lines $S_1$ to $S_n$. The pixel units $P_{11}$ to $P_{nm}$ and the pixel switches $M_{11}$ to $M_{nm}$ are provided at intersections between the scanning lines $S_1$ to $S_n$ and the data lines $D_1$ to $D_m$.

The pixel switches $M_{11}$ to $M_{nm}$ are controlled to be ON or OFF according to scanning pulse signals Vg1 to Vgn provided by the gate driver 13.

When the pixel switches $M_{11}$ to $M_{nm}$ are ON, the pixel units $P_{11}$ to $P_{nm}$ receive gradation voltage signals Gv1 to Gvm from the data driver 12. The gradation voltage signals Gv1 to Gvm are signals corresponding to video data signals VDS. Luminances of the pixel units $P_{11}$ to $P_{nm}$ are controlled according to the gradation voltage signals Gv1 to Gvm for display.

When the display apparatus 100 is a liquid crystal display apparatus, each of the pixel units $P_{11}$ to $P_{nm}$ includes liquid crystal sealed between a transparent electrode (not shown) and a counter substrate provided so as to be opposed to the semiconductor substrate and having one transparent electrode provided over an entire surface thereof. Display is caused by change in transmittance of the liquid crystal for a backlight inside the display apparatus according to a potential difference between the gradation voltage signals Gv1 to Gvm provided to the pixel units $P_{11}$ to $P_{nm}$ and the voltage of the counter substrate.

The data driver 12 receives a modulated clock signal CLK, control signals CS, and the video data signals VDS from the display controller 15, and provides the gradation voltage signals Gv1 to Gvm corresponding to the video data signals VDS to the pixel units $P_{11}$ to $P_{nm}$ via the data lines $D_1$ to $D_m$. The data driver 12 provides the gradation voltage signals Gv1 to Gvm with multiple levels corresponding to the number of gradations to the data lines $D_1$ to $D_m$.

The gate driver 13 receives the modulated clock signal CLK and the control signals CS from the display controller 15, and provides the scanning pulse signals Vg1 to Vgn to the scanning lines $S_1$ to $S_n$ according to the received signals. The gate driver 13 periodically and consecutively provides at least two-valued scanning pulse (for example, square pulse) signals Vg1 to Vgn to the scanning lines $S_1$ to $S_n$.

For every frame period, a video data signal for one screen is rewritten. The pixel units $P_{11}$ to $P_{nm}$ are selected for each of pixel columns corresponding to the scanning lines $S_1$ to $S_n$, and the gradation voltage signals Gv1 to Gvm are provided to the pixel units $P_{11}$ to $P_{nm}$ via the data lines $D_1$ to $D_m$. In the following description, providing the gradation voltage signals Gv1 to Gvm to the pixel units $P_{11}$ to $P_{nm}$ is referred to also as "writing the gradation voltage signals into the pixel electrodes."

The power source circuit 14 supplies necessary source voltages to the data driver 12 and the gate driver 13.

The display controller 15 provides the video data signals VDS to the data driver 12. The display controller 15 also provides the control signals CS and the modulated clock signal CLK to the data driver 12 and the gate driver 13.

The modulated clock signal CLK is a clock signal having a clock frequency that changes at a predetermined rate in one frame period. The display controller 15 includes a modulated clock generation unit for generating the modulated clock signal CLK.

Figure 2A:
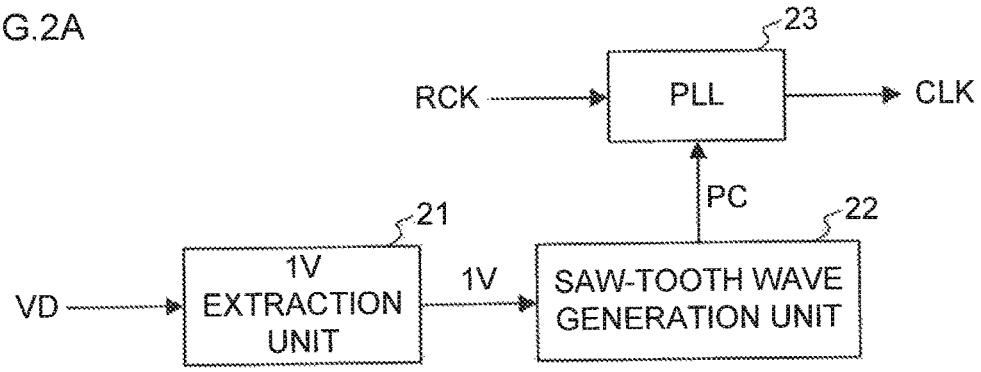
FIG. 2A is a diagram illustrating an exemplary configuration of a modulated clock generation unit.
Figure 2B:
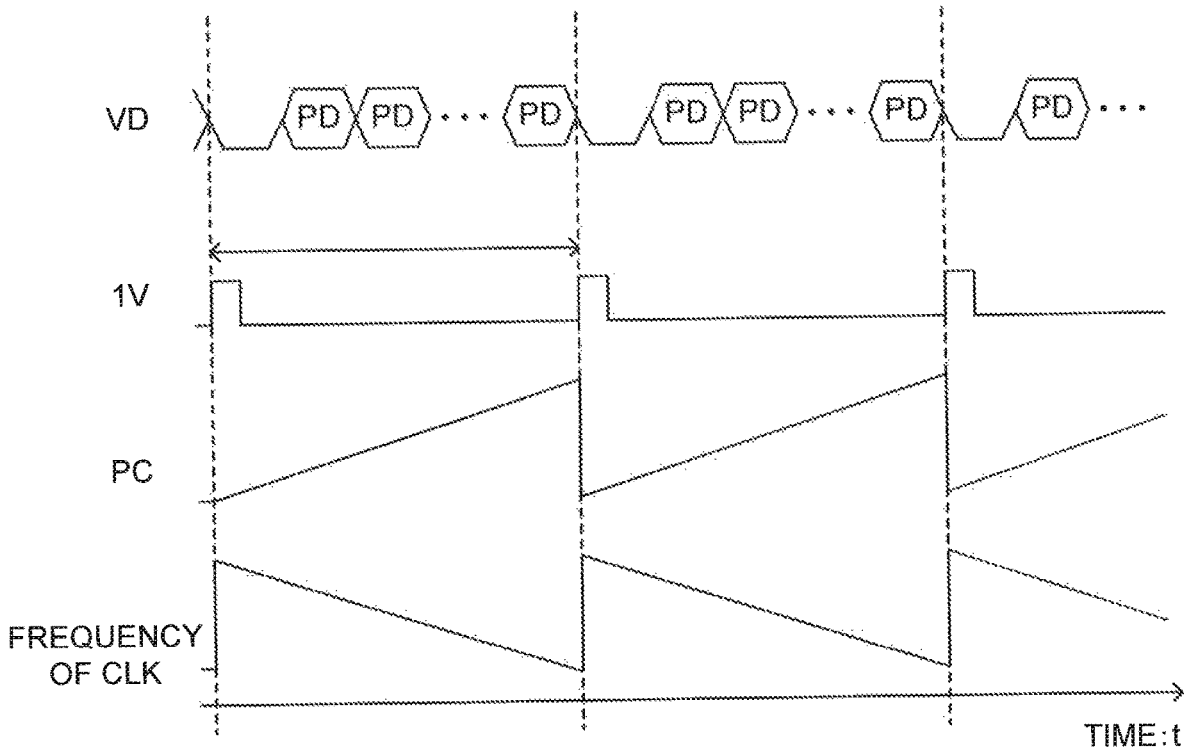
FIG. 2B is a chart showing signals generated by the modulated clock generation unit.

FIG. 2A is a block diagram illustrating an exemplary configuration of the modulated clock generation unit in a simplified manner. The modulated clock generation unit includes a 1V extraction unit 21 for extracting one cycle of a vertical synchronizing signal from the video data signals VDS, for example. The 1V extraction unit 21 extracts a cycle of a vertical synchronizing signal from a video data signal VD comprising a sequence of pixel data PD, and generates a periodic signal 1V having amplitude of one pulse for every such a cycle as shown in FIG. 2B, for example.

The modulated clock generation unit also includes a saw-tooth wave generation unit 22 for generating a saw-tooth wave signal PC. As shown in FIG. 2B, for example, the saw-tooth wave generation unit 22 generates the saw-tooth wave signal PC having a signal level increasing in one cycle of the vertical synchronizing signal.

The modulated clock generation unit also includes a phase locked loop (PLL) 23 that receives a reference clock signal RCK having a constant cycle and generates the modulated clock signal CLK on the basis of the reference clock signal RCK and the saw-tooth wave signal PC. The PLL 23 generates the modulated clock signal CLK having a step-wisely decreasing frequency, for example.

Referring back to FIG. 1, the data driver 12 provides the gradation voltage signals Gv1 to Gvm to the pixel units $P_{11}$ to $P_{nm}$ in a data period corresponding to the cycle of the modulated clock signal CLK.

The gate driver 13 generates the scanning pulse signals Vg1 to Vgn having a pulse width corresponding to the modulated clock signal CLK and provides the scanning pulse signals Vg1 to Vgn to the scanning lines $S_1$ to $S_n$. The pulse width of the scanning pulse signals Vg1 to Vgn becomes a selection period of the pixel switches $M_{11}$ to $M_{nm}$.

Figure 3:
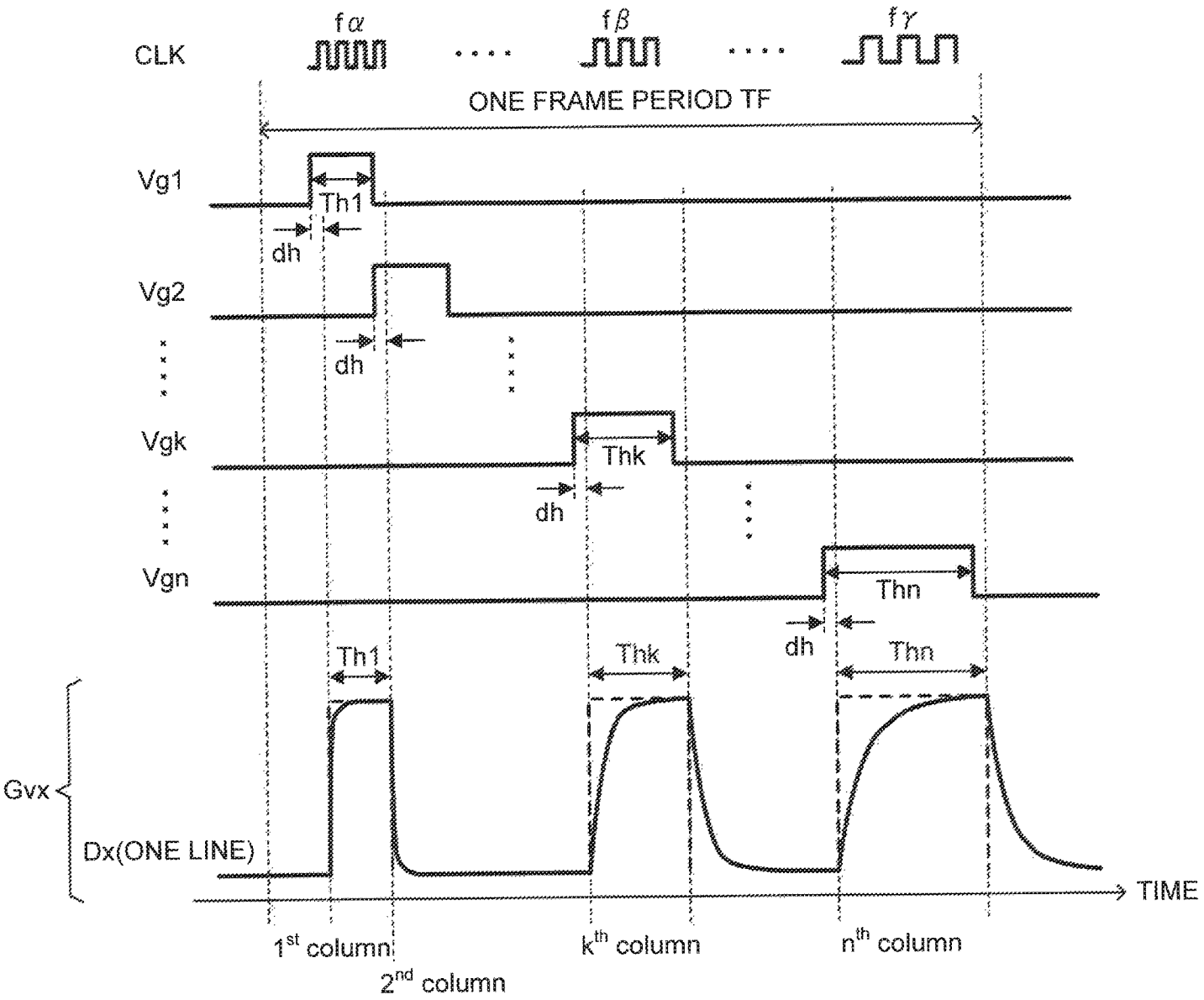
FIG. 3 is a time chart showing a modulated clock signal, scanning pulse signals, and a gradation voltage signal in one frame period.

FIG. 3 is a time chart showing the modulated clock signal CLK, the scanning pulse signals Vg1 to Vgn, and a gradation voltage signal Gvx in a data line Dx in one frame period TF when the display apparatus 100 of the present embodiment is a high-resolution display apparatus having a large screen. Note that the data period and timing for the gradation voltage signals Gv1 to Gvm provided to the data lines $D_1$ to $D_m$ are the same as those for the gradation voltage signal Gvx.

The modulated clock signal CLK is controlled in such a manner that its frequency is high immediately after the start of the one frame period TF and decreases at a predetermined rate toward the latter half of the one frame period TF. Similarly in the next frame period, the frequency of the modulated clock signal CLK is controlled so as to change from a high frequency to a low frequency again.

The pulse width of the scanning pulse signals Vg1 to Vgn (i.e., the selection period of the pixel switches) and a driving period of the gradation voltage signals Gv1 to Gvm (i.e., one data period) are generated by a period corresponding to a duration of counting the modulated clock signal CLK a predetermined number of times (for example, a predetermined multiple of the cycle of the modulated clock signal CLK) using a timing control signal as a reference, for example. Accordingly, when the modulated clock signal CLK has a low frequency (for example, fγ), the selection period of the scanning pulse signals Vg1 to Vgn and one data period of the gradation voltage signals Gv1 to Gym are long. When the modulated clock signal CLK has a high frequency (for example, fα), on the other hand, the selection period of the scanning pulse signals Vg1 to Vgn and one data period of the gradation voltage signals Gv1 to Gvm are short. Thus, the selection period of the scanning pulse signals Vg1 to Vgn and one data period of the gradation voltage signals Gv1 to Gvm immediately after the start of the one frame period TF are short, whereas the selection period of the scanning pulse signals Vg1 to Vgn and one data period of the gradation voltage signals Gv1 to Gvm immediately before the end of the one frame period TF are long.

The scanning pulse signals Vg1, Vg2, . . . , Vgk, . . . , Vgn are scanning pulse signals to be respectively provided to the first scanning line $S_1$, the second scanning line $S_2$, . . . , the k-th scanning line $S_k$, . . . , the n-th scanning line $S_n$ of the display panel 11 that are arranged in this order from the side closer to the data driver 12. The selection of the pixel switches $M_{11}$ to $M_{nm}$ by the scanning pulse signals Vg1 to Vgn is performed sequentially from the scanning line $S_1$ closest to the data driver 12 toward the scanning line $S_n$ farthest from the data driver 12 in one frame period. That is, the pixel switches $M_{11}$ to $M_{nm}$ are sequentially turned ON from a pixel column (1st_column) closest to the data driver 12 toward a pixel column (nth_column) farthest from the data driver 12. This causes the gradation voltage signals Gv1 to Gvm provided to the data lines $D_1$ to $D_m$ by the data driver 12 to be sequentially written into the pixel electrodes for each pixel column.

The gradation voltage signal Gvx shown in FIG. 3 shows a waveform (solid line) of the gradation voltage signal corresponding to the selection periods of the scanning pulse signals Vg1 to Vgn in a data line $D_x$ among the data lines $D_1$ to $D_m$. While the gradation voltage signal Gvx is a voltage signal with multiple levels corresponding to the gradation levels, the gradation voltage signal Gvx here shows a waveform pattern having the maximum amplitude wherein its voltage level reaches a maximum during the selection periods for the purpose of illustration. An ideal pulse waveform of the gradation voltage signal is indicated by a broken line. Since one data period of the gradation voltage signal Gvx is generated on the basis of the modulated clock signal CLK, the length of one data period takes different values in the one frame period TF.

A constant timing difference dh is provided between the selection period of each of the scanning pulse signals Vg1 to Vgn and one data period of the gradation voltage signal Gvx. Also, a blanking period VB is provided from the start of the one frame period TF until the start of the initial data period.

In the one frame period TF, the scanning pulse signals Vg1 to Vgn corresponding to the number of the scanning lines $S_1$ to $S_n$ (i.e., n) and the gradation voltage signal Gvx are provided to the scanning lines $S_1$ to $S_n$ and the data line $D_x$, respectively.

Figure 4:
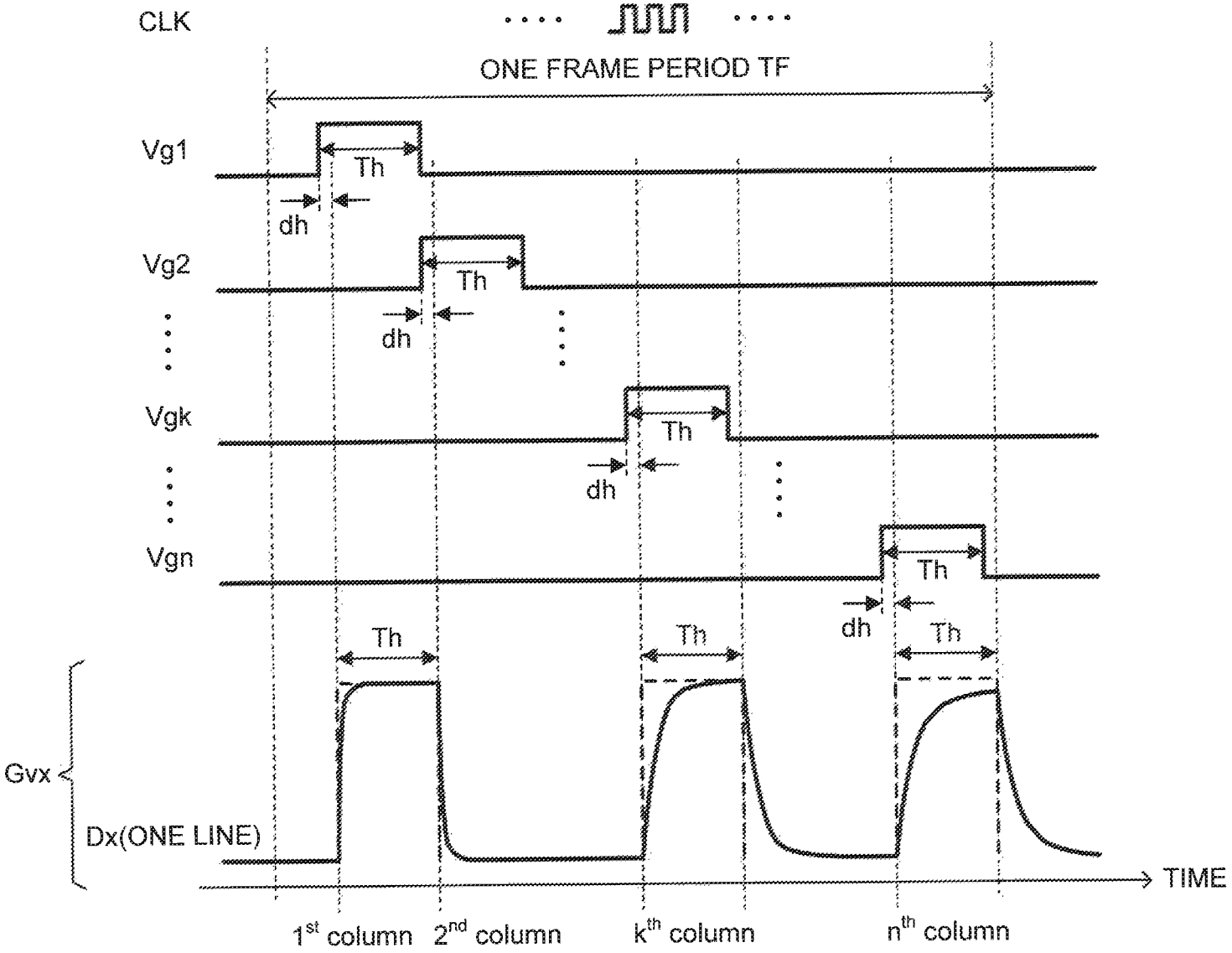
FIG. 4 is a time chart showing a modulated clock signal, scanning pulse signals, and a gradation voltage signal according to a comparative example.

Unlike the display apparatus 100 of the present embodiment, FIG. 4 is a time chart showing, as a comparative example, signals in a standard display apparatus that operates on the basis of a clock signal CLK having a constant frequency in one frame period TF. Here, it is assumed that the display apparatus of the comparative example is a high-resolution display apparatus having a large screen as with FIG. 3. One data period Th of the standard display apparatus is calculated by:

$$Th=(1/F-VB)/n$$

where F is a frame frequency at which screens are rewritten for one second, n is the number of scanning lines for one screen, and VB is a blanking period. The one frame period TF is the inverse of the frame frequency F.

The gradation voltage signal Gvx selected by the scanning pulse signals Vg1 and Vg2 immediately after the start of the one frame period TF is a gradation voltage signal on the side closer to the data driver (hereinafter, referred to as a data line near end). Due to the small influence of data line impedance, the rising edge of the signal waveform of the gradation voltage signal Gvx has a less rounded edge. Thus, the voltage level of the provided gradation voltage signal Gvx can be written into the pixel electrode as it is. The gradation voltage signal Gvx selected by the scanning pulse signal Vgk near the middle of the one frame period TF is a gradation voltage signal in the middle of the data line. Thus, the waveform (the degree of rise in signal level) has a rounded edge due to the influence of the data line impedance. However, the voltage level of the gradation voltage signal Gvx provided by the data driver can be reached in the latter half of a selection period Th, and thus the voltage level can be written into the pixel electrode.

The gradation voltage signal Gvx selected by the scanning pulse signal Vgn immediately before the end of the frame period TF is a gradation voltage signal on the side farther away from the data driver (hereinafter, referred to as a data line far end). Thus, due to the large influence of the data line impedance, the rising edge of the signal waveform has a significantly rounded edge. Consequently, the provided gradation voltage level cannot be reached within one data period, and thus a voltage level below the voltage level of the provided gradation voltage signal Gvx is written into the pixel electrode. Consequently, insufficient writing to the pixel electrode occurs near the data line far end, resulting in luminance variations on the display panel.

Referring back to FIG. 3, in the display apparatus 100 of the present embodiment, the selection periods of the scanning pulse signals Vg1 and Vg2 and one data period (denoted as "Th1") of the gradation voltage signal Gvx immediately after the start of the one frame period TF are generated on the basis of the modulated clock signal CLK with the high frequency fα as described above. Accordingly, the one data period Th1 is shorter than the period Th in the comparative example of FIG. 4. The gradation voltage signal Gvx selected by the scanning pulse signals Vg1 and Vg2 is a gradation voltage signal on the side closer to the data driver 12 (hereinafter, referred to as a data line near end). Accordingly, the gradation voltage signal Gvx is less influenced by data line impedance, and thus the rising edge of the signal waveform has a less rounded edge. Thus, even with the shortened one data period Th1, the voltage level of the provided gradation voltage signal Gvx can be written into the pixel electrode as it is.

The selection period of the scanning pulse signal Vgk and one data period (denoted as "Thk") of the gradation voltage signal Gvx near the middle of the one frame period TF are generated on the basis of the modulated clock signal CLK having a frequency fβ, which is lower than the frequency fα, and set as a period equivalent to the period Th in the comparative example of FIG. 4. Since the gradation voltage signal Gvx selected by the scanning pulse signal Vgk is a gradation voltage signal in the middle of the data line, the waveform has a rounded edge due to the influence of the data line impedance. However, the voltage level of the gradation voltage signal Gvx provided by the data driver 12 can be reached in the latter half of the one data period Thk, and thus the voltage level can be written into the pixel electrode.

The selection period of the scanning pulse signal Vgn and one data period (denoted as "Thn") of the gradation voltage signal Gvx immediately before the end of the one frame period TF are generated on the basis of the modulated clock signal CLK having the frequency fγ, which is lower than the frequency fβ, and set as a period longer than the period Th in the comparative example of FIG. 4. Since the gradation voltage signal Gvx selected by the scanning pulse signal Vgn is a gradation voltage signal in the data line far end, the waveform has a significantly rounded edge due to the large influence of the data line impedance. Owing to the longer one data period Thn, however, the voltage level of the gradation voltage signal Gvx provided by the data driver 12 can be reached within the one data period Thn. Thus, the voltage level can be written into the pixel electrode.

As described above, in the display apparatus 100 of the present embodiment, the display controller 15 provides a modulated clock signal having a frequency that decreases at a predetermined rate in one frame period, for example, the modulated clock signal CLK having a stepwisely decreasing frequency, to the data driver 12 and the gate driver 13. On the basis of the modulated clock signal CLK, the gate driver 13 provides the scanning pulse signals Vg1 to Vgn having pulse widths (selection periods) stepwisely increasing in one frame period to the scanning lines $S_1$ to $S_n$. On the basis of the modulated clock signal CLK, the data driver 12 provides the gradation voltage signals Gv1 to Gvm to the pixel units $P_{11}$ to $P_{nm}$ during data periods having stepwisely increasing duration in one frame period. Thus, the selection period and the data period are increased in the pixel units farther away from the data driver 12. Consequently, the writing voltage to the pixel electrode can reach a desired level (for example, the voltage level of the gradation voltage signal provided by the data driver 12) even when the waveforms (i.e., the degree of rise in signal level) of the gradation voltage signals Gv1 to Gvm have rounded edges due to the influence of the data line impedance.

Figure 5:
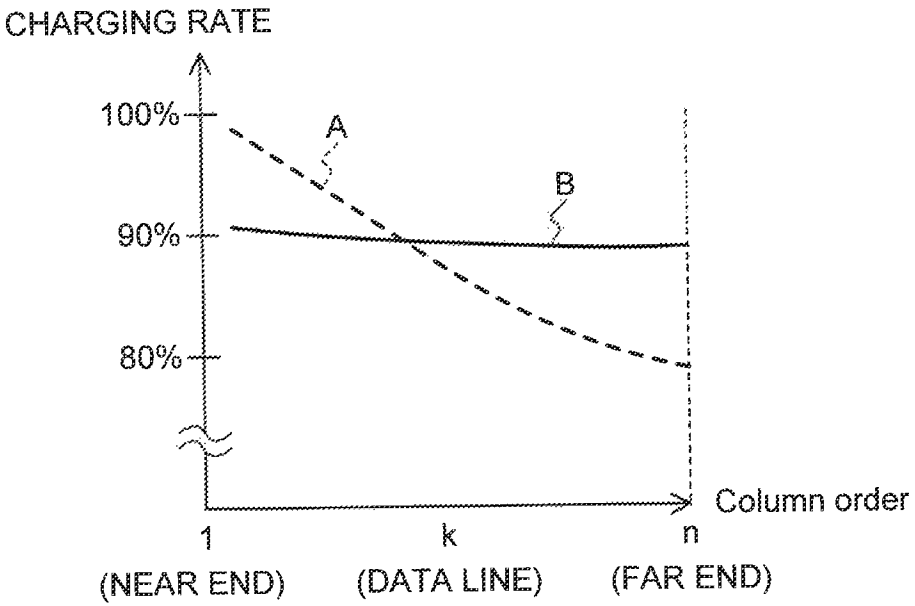
FIG. 5 is a chart showing a relationship between a position on a data line and a charging rate of a pixel unit when a gradation voltage signal has maximum amplitude oscillation.

FIG. 5 is a chart showing a relationship between a position on a data line and a charging rate of a pixel unit in one data period when the gradation voltage signal Gvx has the maximum amplitude oscillation. When one data period of the gradation voltage signal Gvx has a constant length regardless of the distance from the data driver as in the comparative example (FIG. 4), the pixel unit in the data line far end has a decreased charging rate due to the rounded gradation voltage signal Gvx as indicated by broken line (A) in FIG. 5. In contrast to this, when one data period of the gradation voltage signal Gvx has a length corresponding to the distance from the data driver as in the present embodiment (FIG. 3), the charging rate of the pixel unit in the data line near end may be reduced and the charging rate of the pixel unit in the data line far end is increased as indicated by solid line (B) in FIG. 5. This can reduce the difference between the charging rates of the pixel units in the data line near end and in the data line far end. This can reduce luminance unevenness in the panel, which is caused by the difference between the charging rates of the pixel units, and can therefore achieve high image quality.

Thus, the display apparatus 100 of the present embodiment enables display while suppressing luminance unevenness due to the influence of the data line impedance.

While the frequency of the modulated clock signal CLK decreases stepwisely in the one frame period TF in the above description, the frequency of the modulated clock signal CLK may decrease continuously in the one frame period TF. With regard to the decrease rate of the frequency, the frequency may be changed at a constant decrease rate (decline rate). Alternatively, the frequency may be changed while varying the decrease rate.

Figure 6:
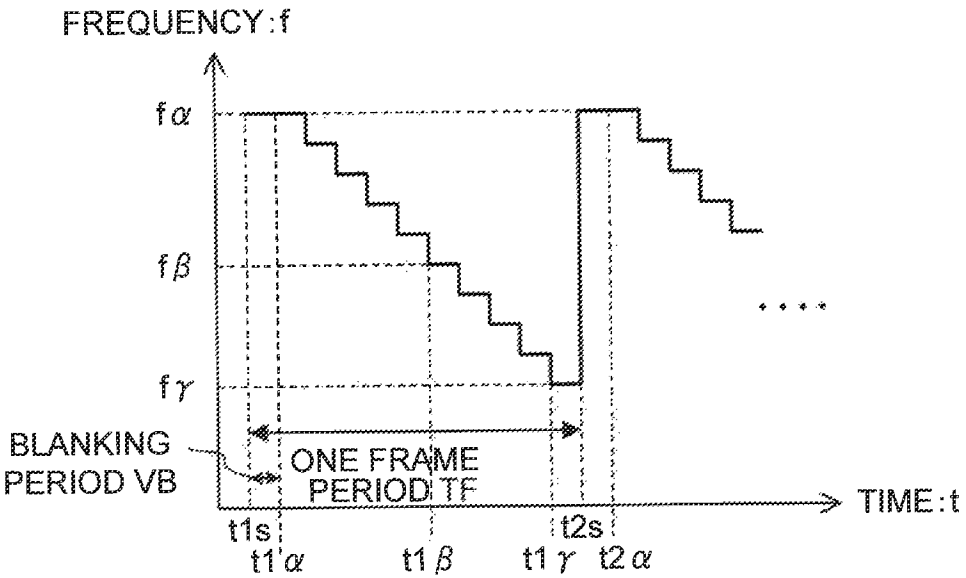
FIG. 6 is a time chart showing a control example when a display controller changes the frequency of the modulated clock signal in a stepwise manner and at a constant decrease rate.

FIG. 6 is a time chart showing a control example when the display controller 15 changes the frequency of the modulated clock signal CLK in a stepwise manner and at a constant decrease rate (decline rate).

Immediately after the start of the one frame period TF (time t1s and t1α), the display controller 15 controls the modulated clock signal CLK so as to have the high frequency fα including the blanking period VB and a predetermined number of data periods. Thereafter, the display controller 15 controls the modulated clock signal CLK so as to change its frequency in a monotonically decreasing manner at a constant decrease rate for every predetermined number of data periods. The display controller 15 controls the modulated clock signal CLK so as to have the low frequency fγ for the predetermined number of data periods immediately before the end of the one frame period TF (time t1γ). After the end of the one frame period TF (time t2s), the display controller 15 promptly restores the frequency of the modulated clock signal CLK to the high frequency fα and performs the similar control also in the next frame period.

Figure 7:
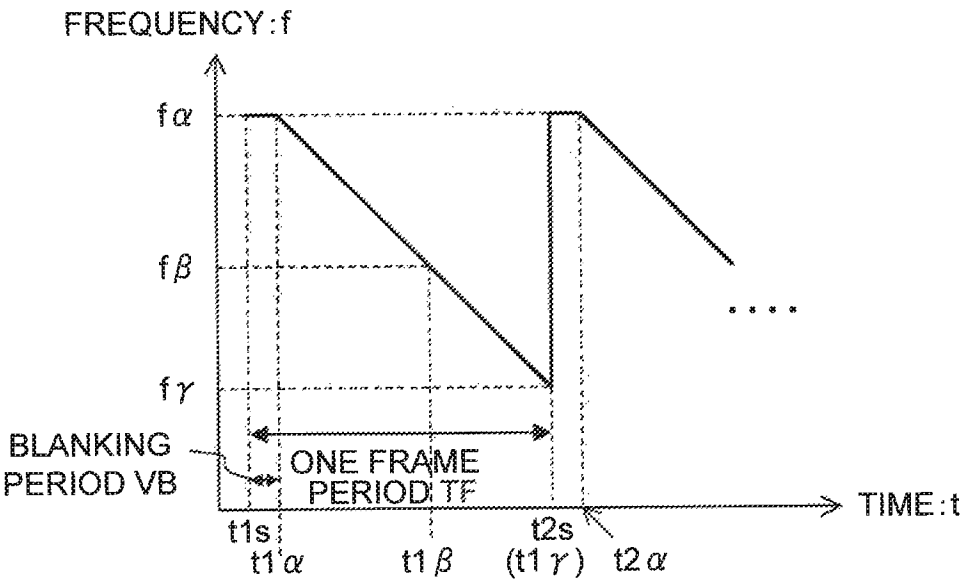
FIG. 7 is a time chart showing a control example when the display controller changes the frequency of a modulated clock signal continuously at a constant decrease rate.

FIG. 7 is a time chart showing a control example when the display controller 15 changes the frequency of the modulated clock signal CLK continuously at a constant decrease rate (decline rate).

The display controller 15 controls the modulated clock signal CLK so as to have the high frequency fα in the blanking period VB (time t1s and t1α) immediately after the start of the one frame period TF, then change the frequency in a monotonically decreasing and continuous manner at a constant decrease rate, and have the low frequency fγ in the data period immediately before the end of the one frame period TF (time t1γ). After the end of the one frame period TF (time t2s), the display controller 15 promptly restores the frequency of the modulated clock signal CLK to the high frequency fα and performs the similar control also in the next frame period. Note that the one data periods Th1, Thk, and Thn are generated on the basis of the frequencies fα, fβ, and fγ of the modulated clock signal CLK, respectively.

Figure 8:
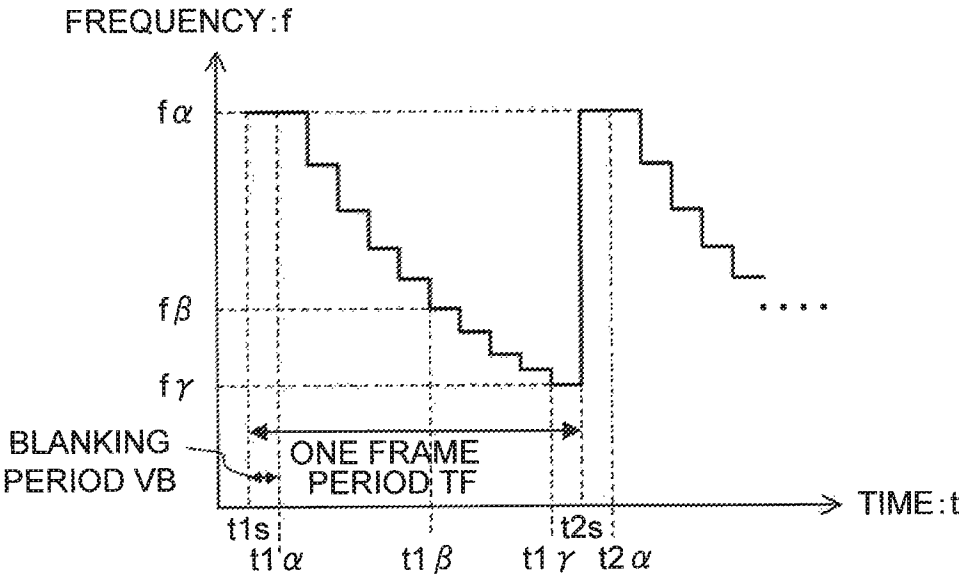
FIG. 8 is a time chart showing a control example when the display controller changes the frequency of the modulated clock signal in a stepwise manner and at a diminishing decrease rate.

FIG. 8 is a time chart showing a control example when the display controller 15 changes the frequency of the modulated clock signal CLK in a stepwise manner and at a diminishing decrease rate (decline rate).

As with the case of FIG. 6, immediately after the start of the one frame period TF (time t1s and t1α), the display controller 15 controls the modulated clock signal CLK so as to have the high frequency fα including the blanking period VB and a predetermined number of data periods. Thereafter, the display controller 15 controls the modulated clock signal CLK so as to change its frequency at a diminishing decrease rate (decline rate) corresponding to rounded rising edges of the signal waveforms of the gradation voltage signals Gv1 to Gvm that are matched with the time constant of data line impedance for every predetermined number of data periods. The display controller 15 controls the modulated clock signal CLK so as to have the low frequency fγ for the predetermined number of data periods immediately before the end of the one frame period TF (time t1γ). After the end of the one frame period TF (time t2s), the display controller 15 promptly restores the frequency of the modulated clock signal CLK to the high frequency fα and performs the similar control also in the next frame period.

Figure 9:
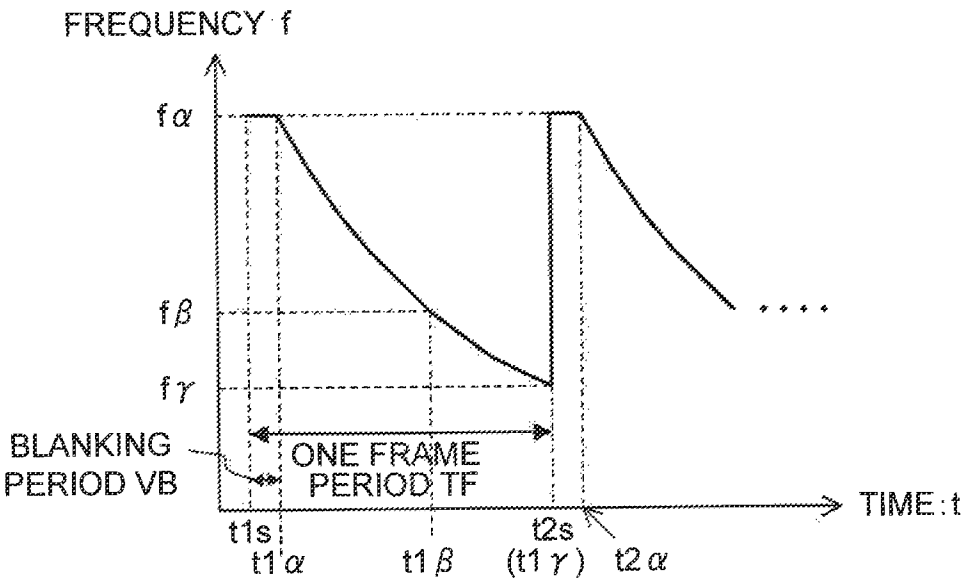
FIG. 9 is a time chart showing a control example when the display controller changes the frequency of a modulated clock signal continuously at a diminishing decrease rate.

FIG. 9 is a time chart showing a control example when the display controller 15 changes the frequency of the modulated clock signal CLK continuously at a diminishing decrease rate (decline rate).

In the blanking period VB (time t1s and t1α) immediately after the start of the one frame period TF, the display controller 15 controls the modulated clock signal CLK so as to have the high frequency fα. Thereafter, the display controller 15 continuously changes the frequency of the modulated clock signal CLK while diminishing the decrease rate (decline rate) so as to correspond to rounded rising edges of the signal waveforms of the gradation voltage signals Gv1 to Gvm that are matched with the time constant of data line impedance for every predetermined number of data periods. The display controller 15 controls the modulated clock signal CLK so as to have the low frequency fγ in the data period immediately before the end of the one frame period TF (time t1γ). After the end of the one frame period TF (time t2s), the display controller 15 promptly restores the frequency of the modulated clock signal CLK to the high frequency fα and performs the similar control also in the next frame period.

Since the display controller 15 is configured by a microfabricated low voltage circuit, adding the function of controlling the frequency of the modulated clock signal CLK as shown in FIGS. 6 to 9 has less influence on a chip area (cost). Thus, the modulated clock signal CLK can be readily generated.

Second Embodiment

A display apparatus of the second embodiment differs from the display apparatus 100 of the first embodiment in that a timing difference between a selection period of each of scanning pulse signals Vg1 to Vgn and one data period of gradation voltage signals Gv1 to Gvm is adjusted.

A display controller 15 of the present embodiment controls a data driver 12 and a gate driver 13 so as to adjust a timing difference dh2 between a selection period of the scanning pulse signals Vg1 to Vgn and one data period of the gradation voltage signals Gv1 to Gvm. Specifically, the display controller 15 controls timing for an operation of providing the gradation voltage signals Gv1 to Gvm by the data driver 12 and an operation of providing the scanning pulse signals Vg1 to Vgn by the gate driver 13. This adjusts the timing difference dh2 to be smaller on the side closer to the gate driver 13 (hereinafter, referred to as a scanning line near end) and to be larger on the side farther away from the gate driver 13 (hereinafter, referred to as a scanning line far end). Such adjustment allows the influence of the impedance of the scanning lines to be suppressed. When a display panel 11 has a high resolution and a large screen such as a 4K panel or an 8K panel, for example, the parasitic capacitance increases due to an increase in the number of crossings of the data line and the scanning line, and the resistance increases as each scanning line becomes longer. Then, the wiring impedance increases. Consequently, the rising edge of the signal waveform of the scanning pulse signal has a rounded edge due to the influence of the impedance of the scanning line.

Figure 10:
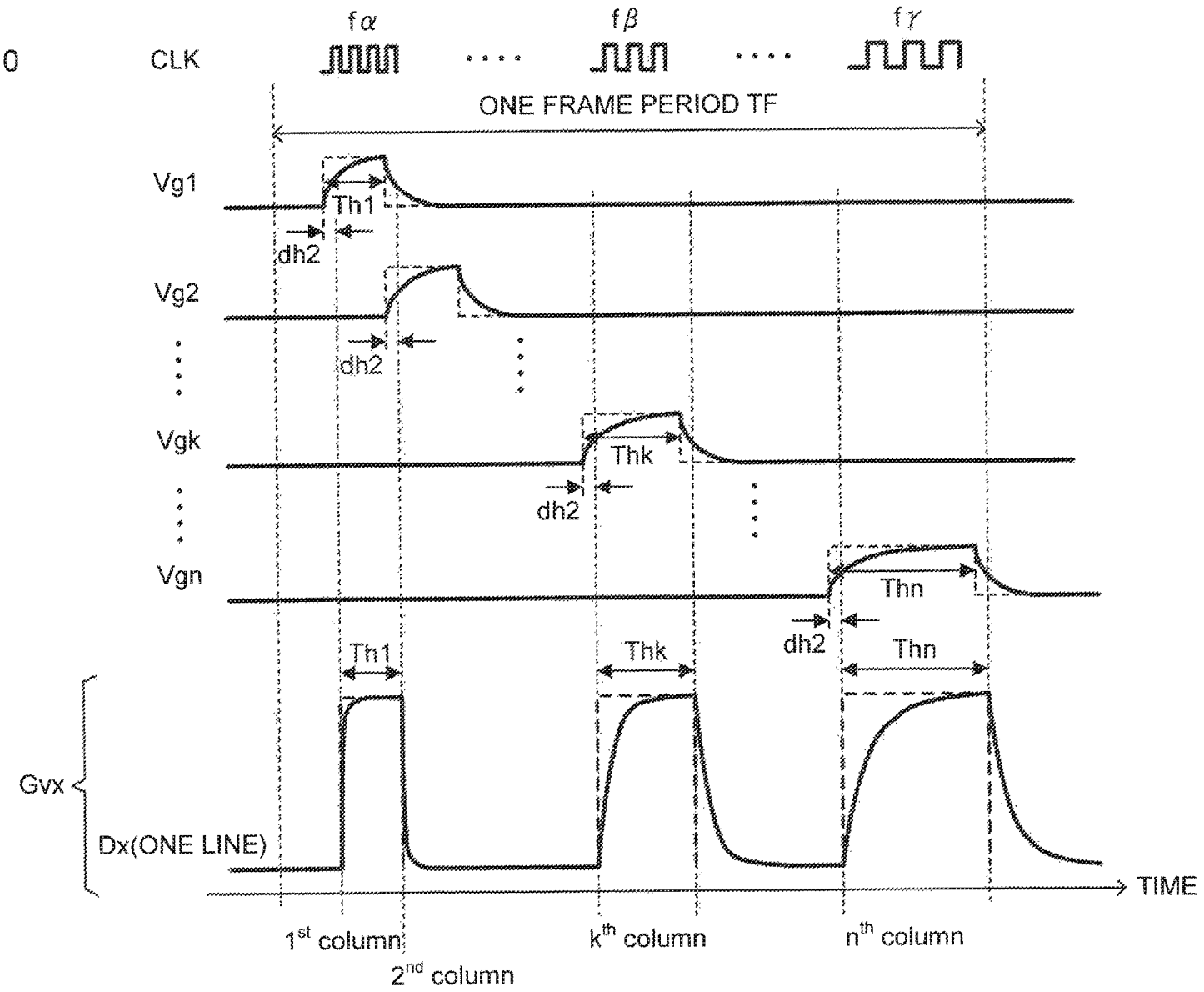
FIG. 10 is a time chart showing a modulated clock signal, scanning pulse signals, and a gradation voltage signal in one frame period according to a second embodiment of the present invention.

FIG. 10 is a time chart showing a modulated clock signal CLK, scanning pulse signals Vg1 to Vgn, and a gradation voltage signal Gvx provided to a data line $D_x$ in one frame period TF that are designed in consideration of the influence of increasing the impedance of the scanning lines.

Since the impedance of the scanning lines $S_1$ to $S_n$ is small in the data line at the scanning line near end, the rising edge of the signal waveform of the scanning pulse signal (the solid lines of Vg1 to Vgn in FIG. 10) has a less rounded edge. Since the impedance of the scanning lines $S_1$ to $S_n$ is large in the data line at the scanning line far end, on the other hand, the rising edge of the signal waveform of the scanning pulse signal (the solid lines of Vg1 to Vgn in FIG. 10) has a significantly rounded edge. Thus, timing for turning the pixel switches $M_{11}$ to $M_{nm}$ ON is delayed in the gate line far end. As a result, the gradation voltage signal may not be sufficiently written to the pixel electrode.

The display apparatus of the present embodiment, however, controls timing for providing the scanning pulse signals Vg1 to Vgn by the gate driver 13 or timing for providing the gradation voltage signal Gvx by the data driver 12 so that a selection period of the scanning pulse signals Vg1 to Vgn and one data period of the gradation voltage signal Gvx are adjusted to have a small timing difference dh2 in the gate line near end and have a large timing difference dh2 in the gate line far end. Consequently, even when timing for turning the pixel switches $M_{11}$ to $M_{nm}$ ON is delayed due to the influence of the impedance of the scanning lines, the voltage level of the gradation voltage signal Gvx can be written to the pixel electrode at timing according to such a delay. Thus, sufficient writing of the gradation voltage signal to the pixel electrode can be performed.

Third Embodiment

A display apparatus of the present embodiment differs from the display apparatus 100 of the first embodiment in that a selection period of each of scanning pulse signals Vg1 to Vgn and one data period of gradation voltage signals Gv1 to Gvm have lengths different from each other.

Figure 11:
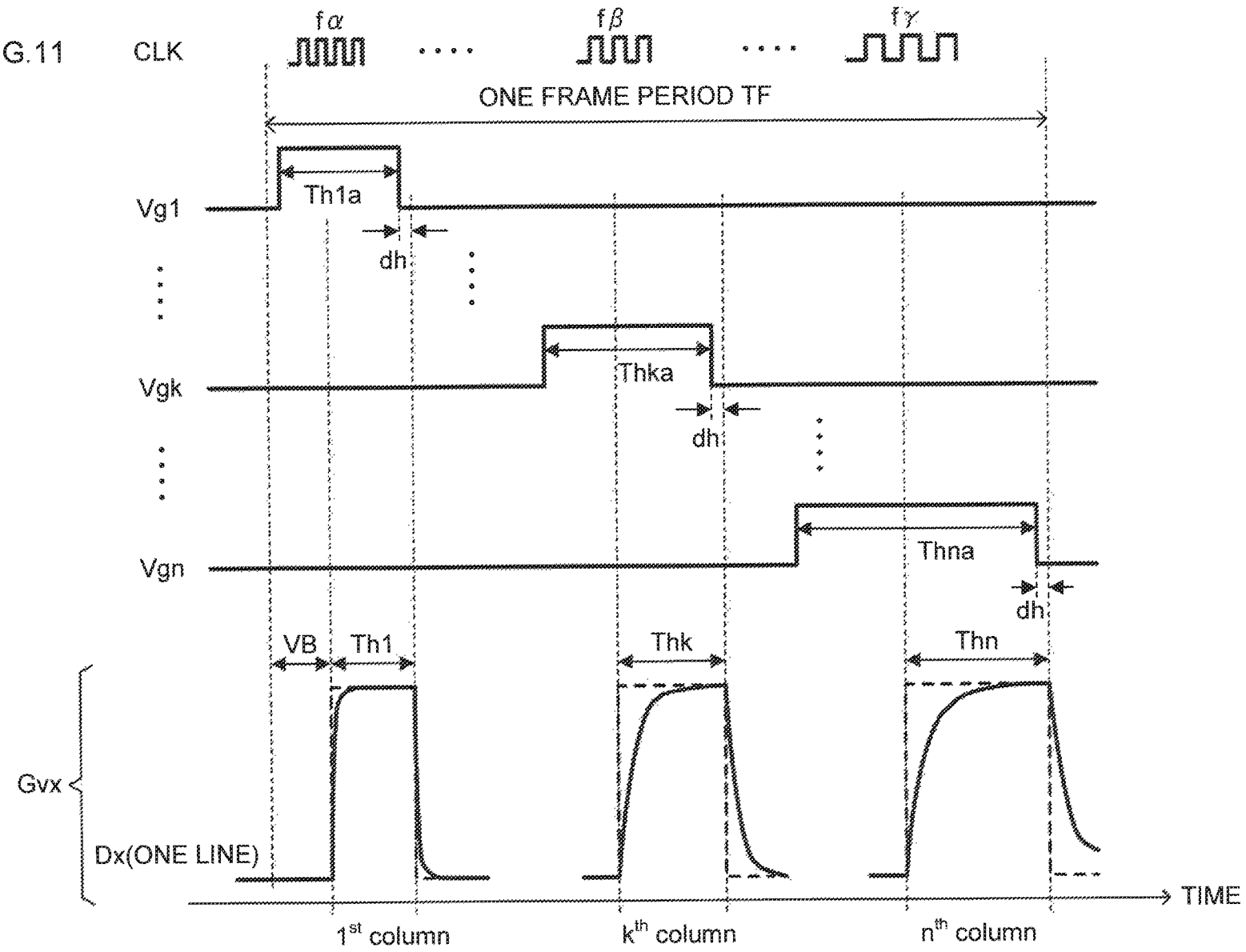
FIG. 11 is a time chart showing a modulated clock signal in one frame period, scanning pulse signals, and a gradation voltage signal in a third embodiment.

FIG. 11 is a time chart showing a modulated clock signal CLK in one frame period TF, the scanning pulse signals Vg1 to Vgn, and a gradation voltage signal Gvx provided to a data line Dx in the display apparatus of the present embodiment. Here, it is assumed that the display apparatus of the present embodiment is driven by a column inversion driving scheme and every gradation voltage signal Gvx in one frame has the same polarity.

A gate driver 13 of the present embodiment generates the scanning pulse signals Vg1 to Vgn each having a pulse width corresponding to the sum of the data period of a gradation voltage signal Gvx provided to one of pixel units $P_{11}$ to $P_{nm}$ and the data period of a gradation voltage signal Gvx provided to a pixel unit in the column immediately preceding to the column of the one of the pixel units $P_{11}$ to $P_{nm}$, or in a column preceding, by a plurality of columns, to the column of the one of the pixel units $P_{11}$ to $P_{nm}$. The gate driver 13 of the present embodiment provides the generated scanning pulse signals Vg1 to Vgn to scanning lines $S_1$ to $S_n$. For example, the gate driver 13 of the present embodiment sets a pulse width Thka of the scanning pulse signal Vgk to a length corresponding to the sum of a data period Thk of the gradation voltage signal Gvx at the k-th column and a data period Th(k-1) (not shown) of the gradation voltage signal Gvx at the (k-1)-th column Note that the timing difference dh is set as a timing difference between the end of selection period of the scanning pulse signals Vg1 to Vgn and the end of one data period of providing the gradation voltage signals Gv1 to Gvm in the present embodiment.

Thus, when writing a gradation voltage signal Gvx into a pixel electrode, a data driver 12 of the present embodiment can perform, as preliminary driving, the writing of a gradation voltage signal Gvx of the same polarity in the column immediately preceding to the column of the pixel electrode or in a column preceding, by a plurality of columns, to the column of the pixel electrode. Thus, the display apparatus of the present embodiment can achieve sufficient charging (writing) to the pixel units $P_{11}$ to $P_{nm}$.

Note that the present invention is not limited to the above-described embodiments. For example, while the display apparatus 100 is a liquid crystal display apparatus in the above-described embodiments, the display apparatus 100 may alternatively be an organic electroluminescence (EL) display apparatus. When the display apparatus 100 is an organic EL display apparatus, each of the pixel units $P_{11}$ to $P_{nm}$ includes an organic EL element and a thin-film transistor for controlling current to be applied to the organic EL element. According to the gradation voltage signals Gv1 to Gvm provided to the pixel units $P_{11}$ to $P_{nm}$, the thin-film transistors control current to be applied to the organic EL elements, and emission luminance of each organic EL element changes according to such current. In this manner, display is performed. Also in the organic EL display apparatus, the application of the present invention enables display while suppressing luminance unevenness.

In the above-described embodiments, the display controller 15 provides, to the data driver 12 and the gate driver 13, the modulated clock signal CLK having a frequency that decreases at a predetermined rate in one frame period TF. Such a frequency change of the modulated clock signal CLK may include not only a change in a decreasing direction but also a change in an increasing direction. In other words, the display controller 15 only needs to provide, to the data driver 12 and the gate driver 13, the modulated clock signal CLK having a frequency that changes at a predetermined rate.

In the above-described embodiments, the gate driver 13 provides the scanning pulse signals Vg1 to Vgn to the scanning lines $S_1$ to $S_n$ in order from the scanning line closest to the data driver 12 (i.e., in the order of the scanning lines $S_1$, $S_2$, . . . , $S_k$, . . . , and $S_n$). The present invention, however, is not limited thereto. The gate driver 13 only needs to be configured to provide the scanning pulse signals Vg1 to Vgn to the scanning lines $S_1$ to $S_n$ in a predetermined order corresponding to distances from the data driver 12 to the scanning lines $S_1$ to $S_n$. Inversely with the aforementioned embodiments, the gate driver 13 may be configured to provide the scanning pulse signals Vgn to Vg1 to the scanning lines $S_n$ to $S_1$ in order from the scanning line farthest from the data driver 12 (i.e., in the order of the scanning lines $S_n$, . . . , $S_k$, . . . , $S_2$, and $S_1$), for example.

Figure 12:
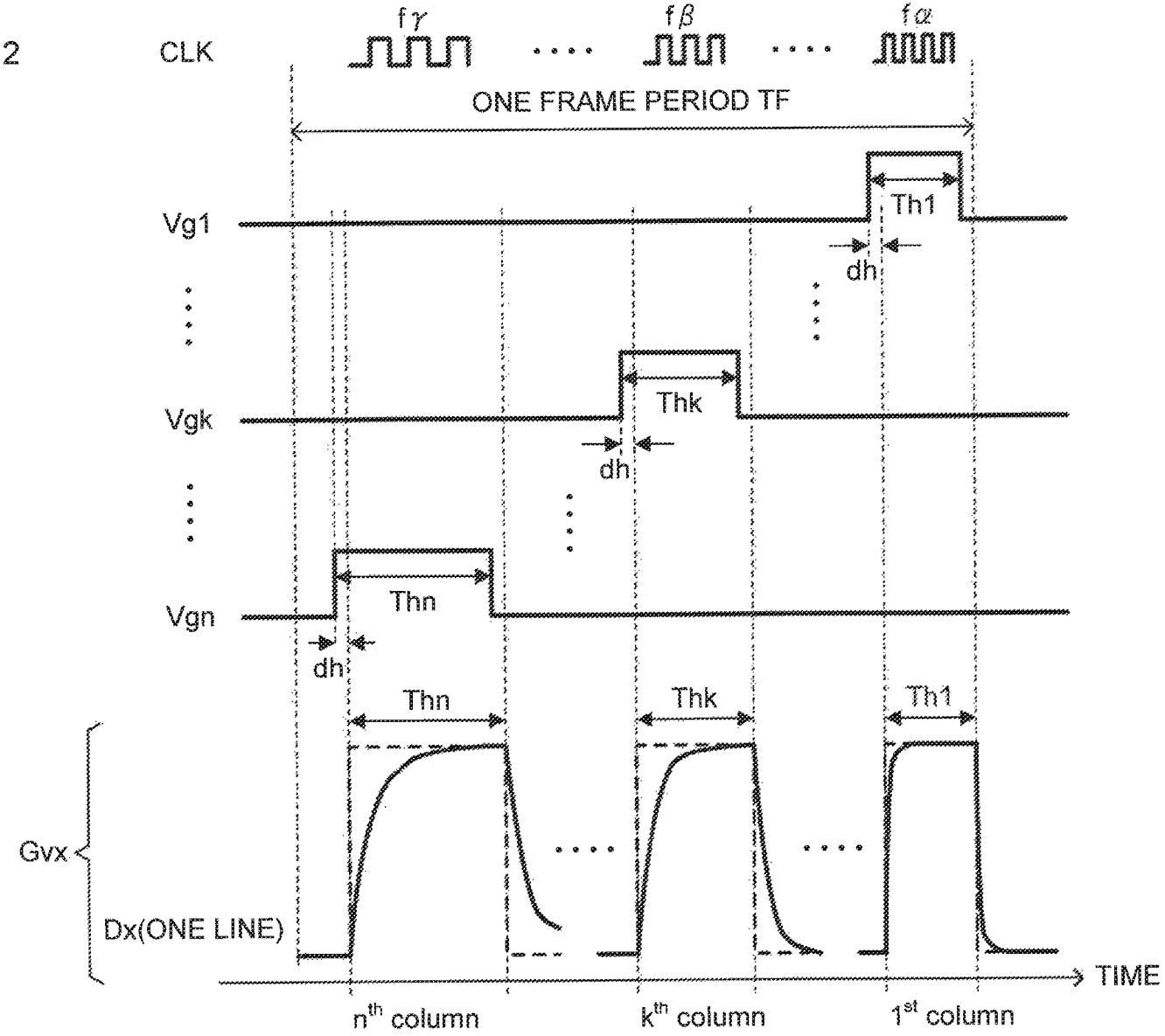
FIG. 12 is a time chart showing a modulated clock signal in one frame period, scanning pulse signals, and a gradation voltage signal in a modified embodiment in which the frequency of the modulated clock signal is increased.

FIG. 12 is a time chart showing a modulated clock signal CLK in one frame period TF, scanning pulse signals Vgn to Vg1, and a gradation voltage signal Gvx provided to a data line Dx when the gate driver 13 provides the scanning pulse signals Vgn to Vg1 to the scanning lines Sn to S1 in order from the scanning line farthest from the data driver 12.

The display controller 15 controls the modulated clock signal CLK so as to have a low frequency immediately after the start of the one frame period TF and increase the frequency at a predetermined rate toward the latter half of the one frame period TF. The pulse width of the scanning pulse signals Vg1 to Vgn and one data period of the gradation voltage signals Gv1 to Gvm are generated by a period corresponding to a duration of counting the modulated clock signal CLK a predetermined number of times. Thus, in the initial phase of the one frame period TF where the modulated clock signal CLK has a low frequency, the pulse width of the scanning pulse signals and the one data period of the gradation voltage signals are long. In the end phase of the one frame period TF where the modulated clock signal CLK has a high frequency, the pulse width of the scanning pulse signals and the one data period of the gradation voltage signals are short.

The gate driver 13 provides the scanning pulse signals Vgn to Vg1 to the scanning lines $S_n$ to $S_1$ in order from the scanning line farthest from the data driver 12 (i.e., in the order of the scanning lines $S_n, \ldots, S_k, \ldots, S_1$). Thus, the scanning pulse signal (Vgn) having a long pulse width is provided to the scanning line ($S_n$) farther from the data driver 12, whereas the scanning pulse signal (Vg1) having a short pulse width is provided to the scanning line ($S_1$) closer to the data driver 12.

The pixel switches $M_{11}$ to $M_{nm}$, are sequentially turned ON from the pixel column farthest from the data driver 12 toward the pixel column closest to the data driver 12. This causes the gradation voltage signal Gvx to be sequentially written into the pixel electrodes for each pixel column. Thus, the gradation voltage signal Gvx having a longer data period is written into the pixel column farther away from the data driver 12, whereas the gradation voltage signal Gvx having a shorter data period is written into the pixel column closer to the data driver 12.

Thus, the writing voltage to the pixel electrode can reach a desired level (the voltage level of the gradation voltage signal provided by the data driver 12) as with the first embodiment even when the waveform (the degree of rise in signal level) of the gradation voltage signal Gvx has a rounded edge due to the effect of the increased data line impedance in the data line far end. Moreover, the decreased charging rate of the pixel unit in the data line near end and the increased charging rate of the pixel unit in the data line far end can reduce the difference between the charging rates of the pixel units in the data line near end and in the data line far end, which becomes a cause of luminance unevenness.

At that time, the frequency of the modulated clock signal CLK may be increased stepwisely or continuously in the one frame period TF. With regard to the rate of change in frequency, the frequency may be changed at a constant increase rate (rise rate). The frequency may alternatively be changed with a varying increase rate.

Figure 13:
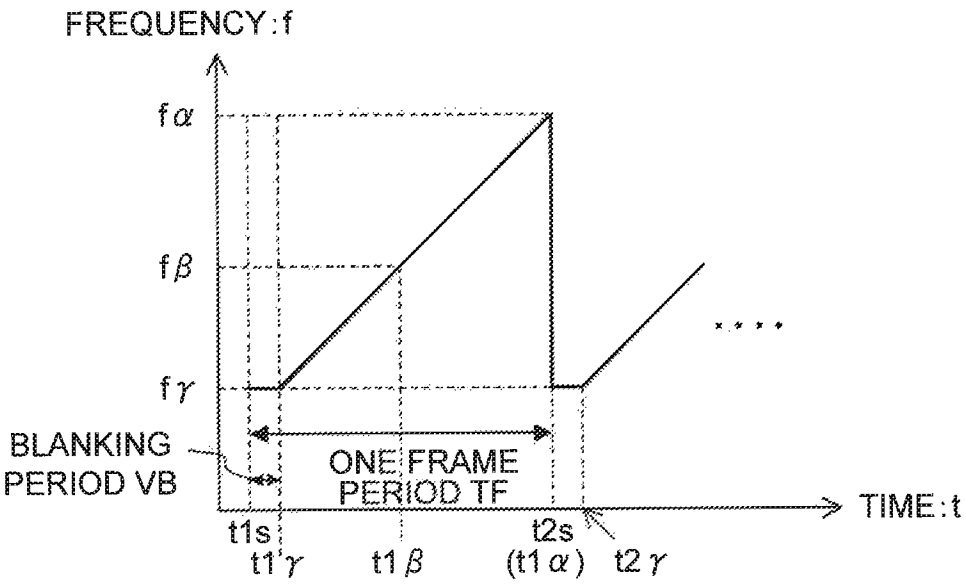
FIG. 13 is a time chart showing a control example when the display controller changes the frequency of a modulated clock signal continuously at a constant increase rate.

FIG. 13 is a time chart showing a control example when the display controller 15 changes the frequency of the modulated clock signal CLK continuously at a constant increase rate. The display controller 15 controls the modulated clock signal CLK so as to have the low frequency fγ in the blanking period VB (time t1s and t1γ) immediately after the start of the one frame period TF, then change the frequency in a monotonically increasing and continuous manner at a constant increase rate, and have the high frequency fα in the data period immediately before the end of the one frame period TF (time t1α). After the end of the one frame period TF (time t2s), the display controller 15 promptly restores the frequency of the modulated clock signal CLK to the low frequency fγ and performs the similar control also in the next frame period.

Figure 14:
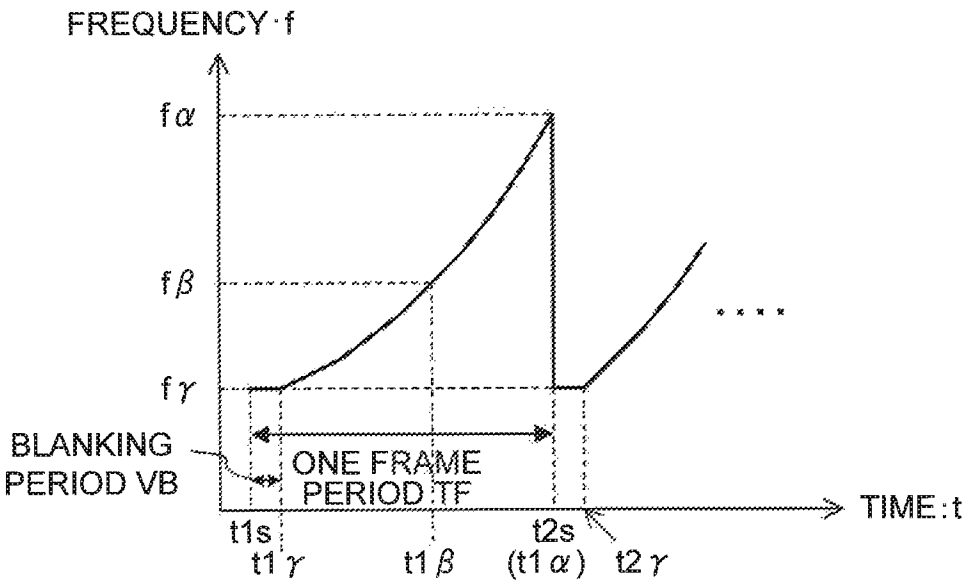
FIG. 14 is a time chart showing a control example when the display controller changes the frequency of a modulated clock signal continuously at a rising increase rate.

FIG. 14 is a time chart showing a control example when the display controller 15 changes the frequency of the modulated clock signal CLK continuously at a rising increase rate. In the blanking period VB (time t1s and t1γ) immediately after the start of the one frame period TF, the display controller 15 controls the modulated clock signal CLK so as to have the low frequency fγ. Thereafter, the display controller 15 continuously changes the frequency of the modulated clock signal CLK while raising the increase rate so as to correspond to rounded rising edges of the signal waveforms of the gradation voltage signals Gv1 to Gvm that are matched with the time constant of data line impedance for every predetermined number of data periods. The display controller 15 controls the modulated clock signal CLK so as to have the high frequency fα in the data period immediately before the end of the one frame period TF (time t1α). After the end of the one frame period TF (time t2s), the display controller 15 promptly restores the frequency of the modulated clock signal CLK to the low frequency fγ and performs the similar control also in the next frame period. Note that the one data periods Th1, Thk, and Thn are generated on the basis of the frequencies fα, fβ, and fγ of the modulated clock signal CLK, respectively.

The configuration of the modulated clock generation unit in the display controller 15 is not limited to the configuration described in the above-described embodiments. The modulated clock generation unit only needs to be configured to be capable of generating a modulated clock signal having a frequency that changes at a predetermined rate.

Figure 15:
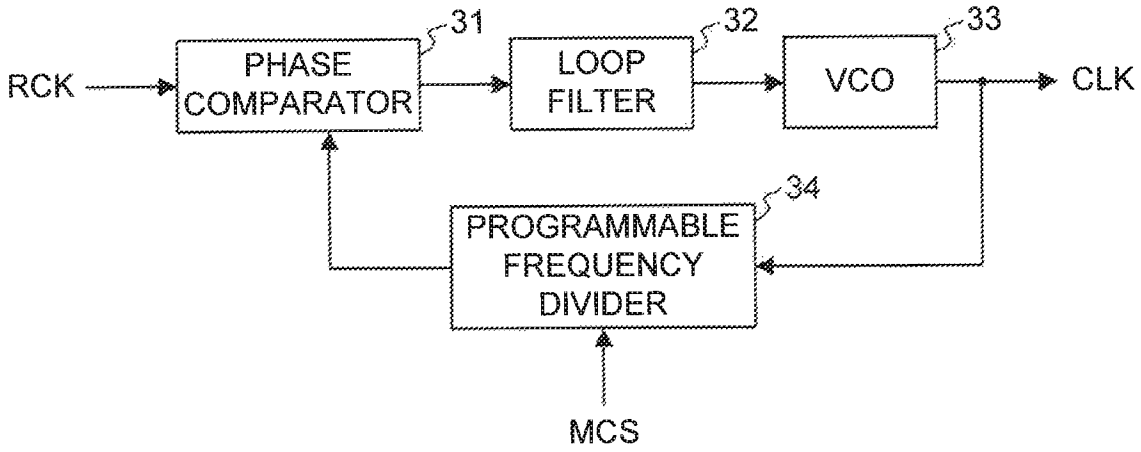
FIG. 15 is a block diagram showing another configuration example of the modulated clock generation unit.

FIG. 15 is a block diagram showing another configuration example of the modulated clock generation unit. The modulated clock generation unit is configured as a PLL circuit including a phase comparator 31, a loop filter 32, a VCO 33, and a programmable frequency divider 34, for example. The programmable frequency divider 34 frequency-divides the modulated clock signal CLK by a frequency division ratio according to an externally provided frequency division ratio control signal MCS. The programmable frequency divider 34 provides the frequency-divided modulated clock signal CLK to the phase comparator 31. Such a configuration can generate the modulated clock signal CLK having a stepwisely or continuously increasing or decreasing frequency.

In the second embodiment described above, the display controller 15 performs the time difference control so as to adjust the timing difference dh2. However, either one of the data driver 12 and the gate driver 13 may be configured to perform timing control so as to adjust the timing difference dh2. In other words, the timing difference dh2 only needs to be adjusted so that a time difference between a selection period and a data period has a length according to a distance from the gate driver 13 to each pixel switch.

The data driver 12 and the gate driver 13 may each be configured as a single driver LSI or may be divided into a plurality of driver LSIs.

The display panel 11 may be a color full high definition (FHD) panel or may be a 4K panel or an 8K panel.

What is claimed is:

1. A data driver configured to receive video data signals and provide gradation voltage signals corresponding to the video data signals through a plurality of data lines to a display panel, wherein the data driver receives the video data signals and a first modulated clock signal each having a frequency that changes at a predetermined rate within one frame period, and the data driver counts clock pulses of the first modulated clock signal so as to set time length of data periods based on periods in which a predetermined number of clock pulses have been counted, generates the gradation voltage signals, the gradation voltage signals having a frequency that changes at the predetermined rate for each of the data periods, provides the gradation voltage signals to the plurality of data lines in an order of scanning a plurality of scanning lines consisting of the display panel, and increases a time of supplying the gradation voltage signals in the order of scanning the plurality of scanning lines.

2. A gate driver configured to provide scanning pulse signals through a plurality of scanning lines to a display panel, wherein the gate driver receives a first modulated clock signal having a frequency that changes at a predetermined rate within one frame period, and the gate driver counts clock pulses of the first modulated clock signal so as to generate the scanning pulse signals, the scanning pulse signals each having a pulse width corresponding to periods in which a predetermined number of clock pulses have been counted, provides the scanning pulse signals to the plurality of scanning lines in a predetermined order, and increases the pulse width of the scanning pulse signals in the predetermined order.

3. A display apparatus comprising:

a display controller configured to send video data signals, a first modulated clock signal having a frequency that changes at a predetermined rate within one frame period, and a second modulated clock signal having a frequency that changes at a predetermined rate within one frame period;

a gate driver configured to count clock pulses of the first modulated clock signal so as to generate scanning pulse signals each having a pulse width corresponding to periods in which a predetermined number of clock pulses have been counted; and a data driver configured to set time length of data periods corresponding to clock cycles of the second modulated clock signal by counting clock pulses of the second modulated clock signal, and generate gradation voltage signals having a frequency that changes at the predetermined rate and are corresponding to the video data signals, for each of the data periods, wherein the first modulated clock signal and the second modulated clock signal are the same modulated clock signals.

4. The display apparatus according to claim 3, further comprising:

a display panel including a plurality of data lines and a plurality of scanning lines intersecting each other, and pixel switches and pixel units arranged in a matrix shape, each of the pixel switches and the pixel units being provided at each of intersections of the plurality of data lines and the plurality of scanning lines, wherein the gate driver provides the scanning pulse signals to each of the plurality of scanning lines such that the pulse width becomes longer as a distance from each of the plurality of scanning lines to the data driver becomes longer, and the data driver provides the gradation voltage signals to each of the plurality of data lines so that a time length of a supply period becomes longer as the pulse width of the scanning pulse signals becomes longer.

5. A display apparatus comprising:

a display panel including a plurality of data lines and a plurality of scanning lines intersecting each other, and pixel switches and pixel units arranged in a matrix shape, each of the pixel switches and the pixel units being provided at each of intersections of the plurality of data lines and the plurality of scanning lines and, a circuit unit that receives video data signals and a modulated clock signal having a frequency that changes at a predetermined rate within one frame period, counts clock pulses of the modulated clock signal so as to generate scanning pulse signals each having a pulse width corresponding to periods in which a predetermined number of clock pulses have been counted, provides the scanning pulse signals to the plurality of scanning lines in a predetermined order, sets time length of data periods based on periods in which a predetermined number of clock pulses of the modulated clock signal have been counted, generates gradation voltage signals having a frequency that changes at the predetermined rate and are corresponding to the video data signals for each of the data periods, and provides the gradation voltage signals to the plurality of data lines in an order of scanning the plurality of scanning lines.

* * * * *